US006588384B2

(12) United States Patent
Yapici

(10) Patent No.: US 6,588,384 B2
(45) Date of Patent: Jul. 8, 2003

(54) APPARATUS FOR VARYING THE COMPRESSION RATIO OF AN INTERNAL-COMBUSTION ENGINE

(75) Inventor: Kurt Imren Yapici, Eschweiler (DE)

(73) Assignee: FEV Motorentechnik GmbH, Aachen (DE)

( * ) Notice: Subject to any disclaimer, the term of this patent is extended or adjusted under 35 U.S.C. 154(b) by 96 days.

(21) Appl. No.: 09/971,044

(22) Filed: Oct. 5, 2001

(65) Prior Publication Data

US 2002/0043229 A1 Apr. 18, 2002

(30) Foreign Application Priority Data

Oct. 16, 2000 (DE) ..... 100 51 271

(51) Int. Cl.[7] ..... F02B 75/04
(52) U.S. Cl. ..... 123/78 F; 123/48 B
(58) Field of Search ..... 123/48 B, 78 F, 123/48 R, 78 R, 78 E, 197.4

(56) References Cited

U.S. PATENT DOCUMENTS

| | | | | | |
|---|---|---|---|---|---|
| 3,407,628 | A | * | 10/1968 | Eccher | 464/103 |
| 4,346,677 | A | * | 8/1982 | Nye | 123/53.1 |
| 4,439,168 | A | * | 3/1984 | Orain | 464/69 |
| 4,612,882 | A | * | 9/1986 | Bonfilio | 123/44 R |
| 5,700,186 | A | * | 12/1997 | Hykes et al. | 451/406 |
| 5,845,397 | A | * | 12/1998 | Reedy et al. | 29/888.011 |
| 6,247,430 | B1 | | 6/2001 | Yapici | 123/78 F |
| 6,443,106 | B1 | * | 9/2002 | Pischinger et al. | 123/48 B |
| 6,510,821 | B2 | * | 1/2003 | Fujimoto et al. | 123/48 B |

FOREIGN PATENT DOCUMENTS

| | | |
|---|---|---|
| DE | 29 35 073 | 3/1981 |
| DE | 29 35 977 | 3/1981 |
| DE | 30 04 402 | 8/1981 |
| DE | 30 30 615 | 2/1982 |
| DE | 36 01 528 | 7/1987 |
| DE | 36 44 721 | 7/1988 |
| DE | 37 15 391 | 11/1991 |

* cited by examiner

*Primary Examiner*—Henry C. Yuen
*Assistant Examiner*—Douglas A. Salser
(74) *Attorney, Agent, or Firm*—Venable LLP; Norman N. Kunitz

(57) ABSTRACT

A piston-type internal-combustion engine has an apparatus for shifting the crankshaft axis to vary the compression ratio. The apparatus has eccentric rings rotatably supported in the engine block. The crankshaft is eccentrically supported in the rings whereby the crankshaft axis is radially spaced from the ring axis. A setting arm, carrying a toothed element, projects from each ring. A setting shaft is rotatably supported on the engine block parallel to the crankshaft. Pinion elements are provided, each having a first pinion fixedly secured to the setting shaft and meshing with the toothed element of one of the setting arms and a second pinion rotatable relative to the first pinion and meshing with the toothed element of one of the setting arms. A resilient connecting member couples the first and second pinions to one another and resiliently resists a rotation of the first and second pinions relative to one another.

13 Claims, 6 Drawing Sheets

APPARATUS FOR VARYING THE COMPRESSION RATIO OF AN INTERNAL-COMBUSTION ENGINE

CROSS REFERENCE TO RELATED APPLICATION

This application claims the priority of German Application No. 100 51 271.2 filed Oct. 16, 2000, which is incorporated herein by reference.

BACKGROUND OF THE INVENTION

This invention relates to an apparatus for changing the compression ratio in a reciprocating piston type internal-combustion engine.

In the usual piston drives in internal-combustion engines the position of the piston in its cylinder depends exclusively from the angular position of the engine crankshaft. For changing the compression ratio as a function of operational conditions, it is known to provide an adjusting arrangement in which the connecting rod of the piston is subdivided into two connecting rod portions which are coupled to one another by a central joint and further, a control arm is articulated at one end to the connecting rod. The other end of the control arm is secured to a support which is displaceably mounted on the engine housing. Such constructions are described, for example, in German Published Applications 29 35 073, 29 35 977, 30 30 615 and 37 15 391. In these constructions the control arm is directly coupled to the central joint which involves significant structural and operational problems. The central joint has a substantial width and is therefore very heavy. Its substantial weight, however, cannot be compensated for by counterweights mounted on the crankshaft because of the limited space available in the engine. It is an overall disadvantage of these prior art constructions that the moved masses, that is, the pistons and the connecting rods are increased and thus a larger weight has to be overcome.

To avoid the above-outlined disadvantages, it has been attempted to change the compression ratio by supporting the crankshaft in eccentric rings rotatably mounted in the engine block and connected with a setting drive. By turning the eccentric rings the position of the rotary axis of the crankshaft is shifted, as a result of which in the upper dead center of the piston its the distance from the cylinder top (roof) is varied. For this purpose, German Published Patent Application 30 04 402 provides that each eccentric ring is coupled with a gear which meshes with a pinion mounted on a setting shaft. The setting shaft is oriented parallel to the crankshaft and is connected with a setting drive. Apart from the substantial structural outlay, such a construction requires increased space for accommodating the eccentric rings and the gears disposed adjacent thereto.

Further, German Published Application 36 01 528 discloses an arrangement in which the eccentric rings carrying the crankshaft bearing are connected with a partially cylindrical shell oriented concentrically to the eccentric rings and extending along the entire length of the engine block. On its outer face the shell is provided with a toothed segment which meshes with a setting worm oriented transversely to the crankshaft and being connected with a setting drive. Such a system, despite a favorable structural length as concerns the crankshaft bearing, has the disadvantage that a very compact structural member is provided for the synchronous shifting of the eccentric rings. Further, the torques generated due to the eccentricity of the crankshaft bearings relative to the bearing axis of the eccentric rings can be taken up solely by the setting worm. Since at all times only a few teeth are in a meshing relationship with such a setting worm with a slight degree of overlap, the material of the components is exposed to substantial stresses because of the pulsating loads occurring during operation. Even a slight play between the toothed segment and the setting worm may lead to a rapidly progressing wear.

In addition, German Published Application 36 44 721 describes a system in which each eccentric ring is connected with a laterally projecting lever which is coupled to a slide at its free end. Laterally and parallel to the crankshaft a setting shaft is supported which is provided with a setting drive and fork-like claws surrounding the slide of the respective eccentric rings. Since slides cannot be guided in a practically play-free manner, this system too, has the disadvantage that because of the pulsating torques acting through the eccentric rings, the components are, in that region, exposed to significant stresses. This leads to an increasing wear in the guide for the slides.

U.S. Pat. No. 6,247,430 discloses further examples of setting devices of the above-outlined type. All known embodiments, however, require a particular configuration of the engine block.

SUMMARY OF THE INVENTION

It is an object of the invention to provide an improved compression ratio setting device of the above-outlined type which is structurally simpler and is easier to manufacture.

This object and others to become apparent as the specification progresses, are accomplished by the invention, according to which, briefly stated, the internal-combustion engine includes an engine block; a plurality of cylinders arranged in line in the engine block; a piston accommodated for reciprocating motion in respective cylinders and each having an upper dead center position; a plurality of eccentric rings; ring bearings for supporting the eccentric rings in the engine block for rotation about a ring axis; a crankshaft; a plurality of crankshaft bearings supported in respective eccentric rings and carrying the crankshaft for rotation about a crankshaft axis which is radially spaced from the ring axis; a connecting rod coupling each piston to the crankshaft; a setting arm secured to and projecting from each eccentric ring; a toothed element carried by each setting arm; and a setting shaft rotatably supported on the engine block parallel to the crankshaft. A plurality of pinion elements are provided, each having a first pinion fixedly secured to the setting shaft and meshing with the toothed element of one of the setting arms and a second pinion rotatable relative to the first pinion and meshing with the toothed element of one of the setting arms. A resilient connecting member couples the first and second pinions to one another and resiliently resists a rotation of the first and second pinions relative to one another. A setting drive turns the setting shaft for adjusting together an angular position of the eccentric rings to radially shift the crankshaft axis, whereby the upper dead center position of the pistons is altered for varying a compression ratio of the engine.

An internal-combustion engine constructed as outlined above has the advantage that the setting shaft situated laterally next to the crankshaft and extending parallel thereto may be arranged in a region of the engine block which is practically not exposed to forces acting between the cylinders on the one hand and the crankshaft on the other hand. Such an arrangement has the substantial advantage that the components of the engine block designed for the force path are undisturbed. Accordingly, an already existing engine block may be modified by slight and relatively simple configurational changes by adding the bearing region for the setting shaft. The outer dimensions of the crankshaft housing need practically not be changed and thus no increased space for the engine needs to be provided in the vehicle. It is particularly expedient to arrange the setting shaft, together with its bearing, laterally to the respective principal bearings of the crankshaft.

During operation, the force components oriented in the direction of the cylinder axis and acting on the crankshaft apply a torque on the eccentric rings as a function of their eccentricity. Since such a torque has to be taken up by the setting arms and the setting drive, the earlier-described conventional systems—inasmuch as the transmission of the setting forces is effected by gears—have the disadvantage that the teeth during operation become worn, which will lead to an unavoidable play between the teeth. By using the pinion element according to the invention, any play between the teeth can be eliminated by biasing the two pinions of the pinion element resiliently against one another. This may be implemented in the simplest way by providing that the tooth element of each setting arm is acted upon by a respective pinion element.

According to an advantageous feature of the invention, the tooth elements belonging to adjoining setting arms are coupled to one another by one pinion element. In this manner a chain-like transmission of the setting torque occurs from one end of the setting shaft to its other end, because each setting arm is exposed from one side to a resiliently tensioned pinion and from the other side to a pinion fixedly attached to the setting shaft. In accordance with another advantageous feature of the invention this construction allows the coupling of the two pinions of the pinion elements to one another by a tubular torsion spring bar. The pinion element is simple to manufacture and provides for a suitable configuration to allow the use of a tubular torsion spring bar constituting the springs required for biasing the two pinions against one another, that is, the tubular torsion spring bar resiliently resists a relative rotation between the two pinions belonging to the same pinion element. The length of the pinion element, that is, the distance between the two pinions, approximately corresponds to the distance between two cylinder axes, that is, between two principal bearings of the crankshaft.

In accordance with another advantageous feature of the invention, the setting shaft is hollow and the pinion elements are fixedly secured to the setting shaft at local enlarged portions of the setting shaft. Such an enlargement of the hollow shaft is provided only in the region of that pinion of the pinion element which is to be fixedly connected with the setting shaft. This provides for the possibility to dimension the inner diameter of the tubular torsion spring bar, on the one hand, and the outer diameter of the non-deformed portions of the hollow setting shaft, on the other hand, such that a slide bearing fit is provided. Accordingly, the relatively rotatable pinion is journaling on the hollow shaft while the fixed pinion is firmly secured to the shaft enlargement.

In accordance with a further advantageous feature of the invention, the setting shaft is provided with bearing members for supporting the setting shaft in the engine block. The outer diameter of the bearing members is greater than the outer diameter of the pinions. This arrangement makes it unnecessary to divide respective regions of the engine block for supporting the setting shaft. Rather, corresponding through bores are provided in the respective regions of the engine block. Since the bearings for the setting shaft are expediently always situated laterally adjacent a principal crankshaft bearing, in case a frame or grid-shaped bearing component ("bed-plate") is used which covers the underside of the engine block along its entire length, it is feasible to also provide it with the bearings for the setting shaft.

The bearing components too, may be fixedly secured to the setting shaft by providing it with local enlargements. Since the setting shaft is not rotated continuously, particular slide bearing bushings or slide bearing shells are not required. The setting shaft, with its bearing components, may be directly supported in the engine block which may be a gray casting or a light metal casting. Oil supply may occur via "catching" ports.

According to a further preferred feature of the invention, the eccentric rings are composed of two parts, and the parting plane passes through the rotary axis of the crankshaft. Further, at least one of the eccentric ring parts is provided with a setting arm having a toothed element. As a modification, it is feasible to provide each ring part with a setting arm and a toothed element, in which case the two setting arms laterally straddle the bearing housing for the eccentric ring. Since, by virtue of the special configuration of the pinion elements according to the invention a play between teeth is eliminated, according to an advantageous feature of the invention the eccentric ring parts are formed as one-piece structures with the setting arm and the toothed element and may expediently be sintered components. In this manner, a substantial cost reduction may be achieved since the structural component composed of the eccentric ring, the setting arm and the toothed element needs machining only on the external circumference of the eccentric ring serving as a bearing surface for the ring and the inner circumference of the eccentric ring serving as a bearing surface for the crankshaft. The precision of the teeth, when made of a sintered component, is sufficient since for adjusting the compression ratio the setting arm has to be pivoted in the one or the other direction only through a relatively small setting angle.

The setting drive for actuating the setting shaft may be a separate setting motor provided with a step-down gearing and controlled by the engine control unit.

In accordance with a further advantageous feature of the invention a setting drive is provided which includes a driven gear having a large outer diameter. The driven gear is keyed to the setting shaft. Two small-diameter driving gears are in a continuous meshing engagement with the large-diameter driven gear and are coupled to a respective clutch. The rotary input components of the two clutches are rotated in opposite directions and, upon engaging the selected clutch, its rotary output component is, via the associated small-diameter driving wheel, torque-transmittingly connected to the large-diameter driven wheel to thus turn the setting shaft in the one or the other direction. Further, an arresting brake is provided which is released upon engaging the clutch. Advantageously, the clutch is a magnetic slip clutch which, on the one hand, ensures a jar-free rotation of the setting shaft and, on the other hand, may reduce the setting speed in addition to the transmission ratio determined by the small-diameter driving gears and the large-diameter driven gear. This also provides for the possibility to operate the setting drive from the crankshaft via a drive belt at the end face of the engine block. Thus, during operation the rotary input components of the clutches run freely, and only upon engaging one of the two clutches will a driving torque be transmitted by the engaged clutch. Then, as the arresting brake is released, a rotation of the setting shaft occurs, shifting the axis of rotation of the crankshaft to thus change the displacement volume of the cylinders.

DESCRIPTION OF THE PREFERRED EMBODIMENT

Figure 1:
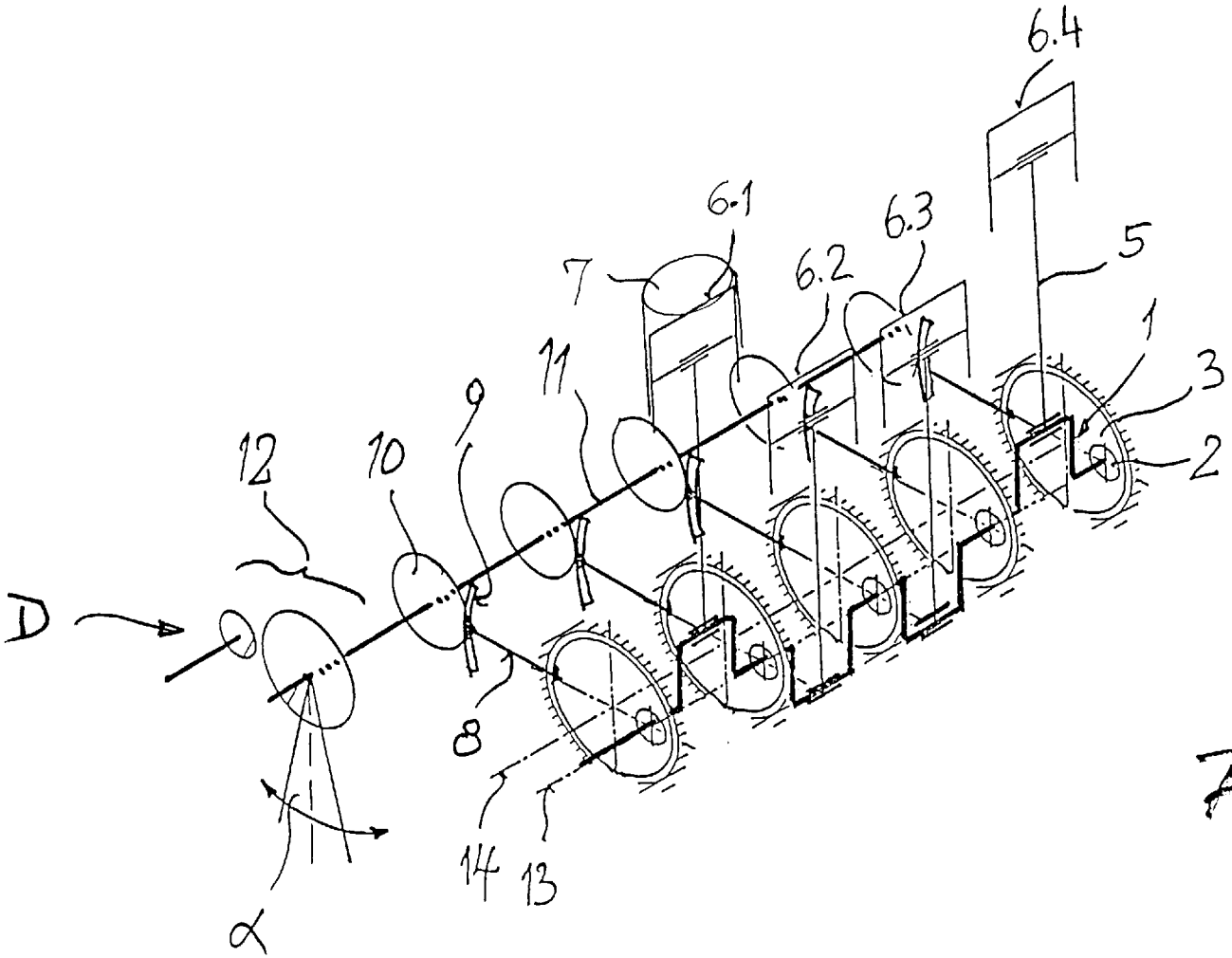
FIG. 1 is a schematic perspective view of a four-cylinder engine showing the principle of the invention.
Figure 2:
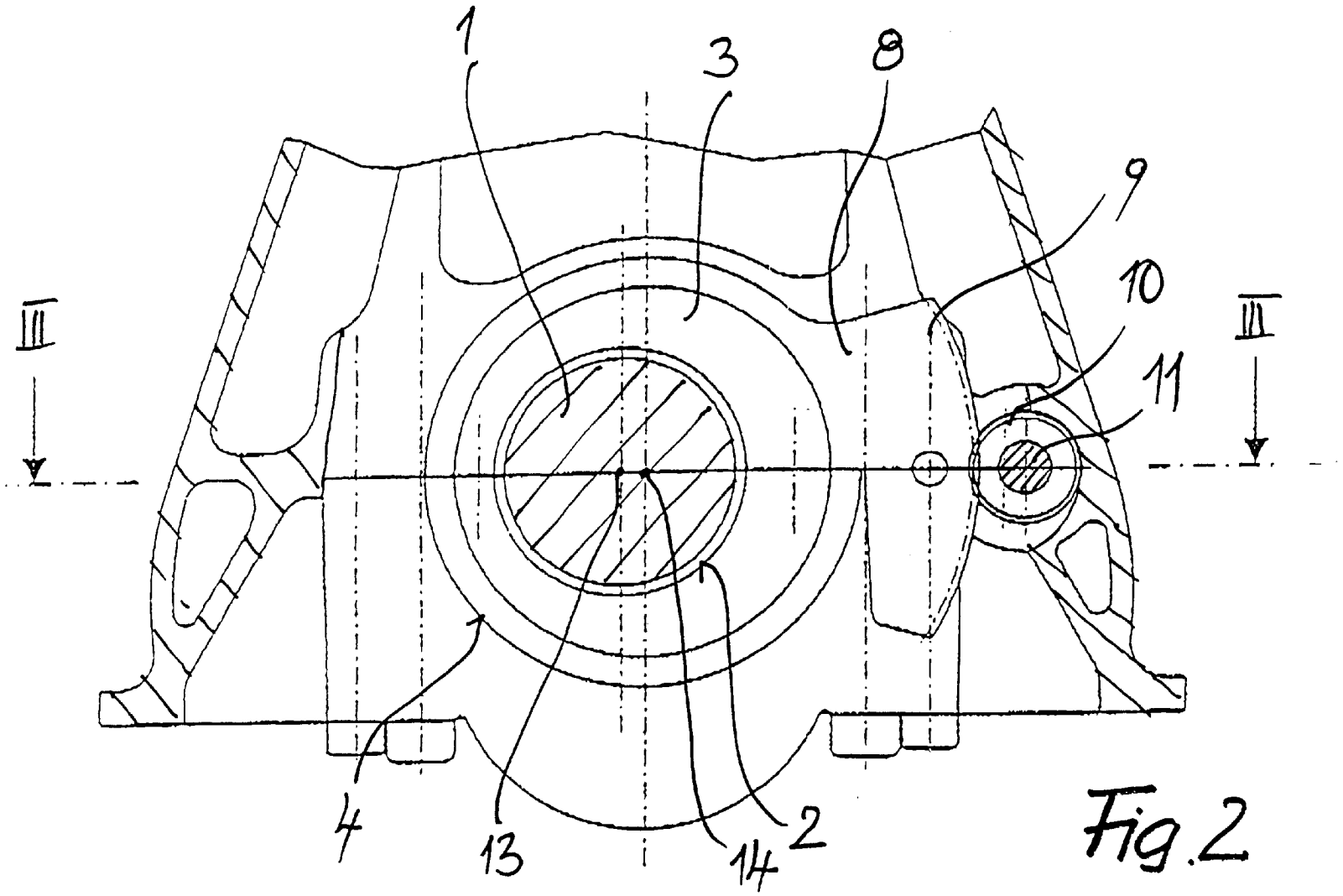
FIG. 2 is a sectional view of an engine block in the region of a principal crankshaft bearing, taken along line II—II of FIG. 3.
Figure 3:
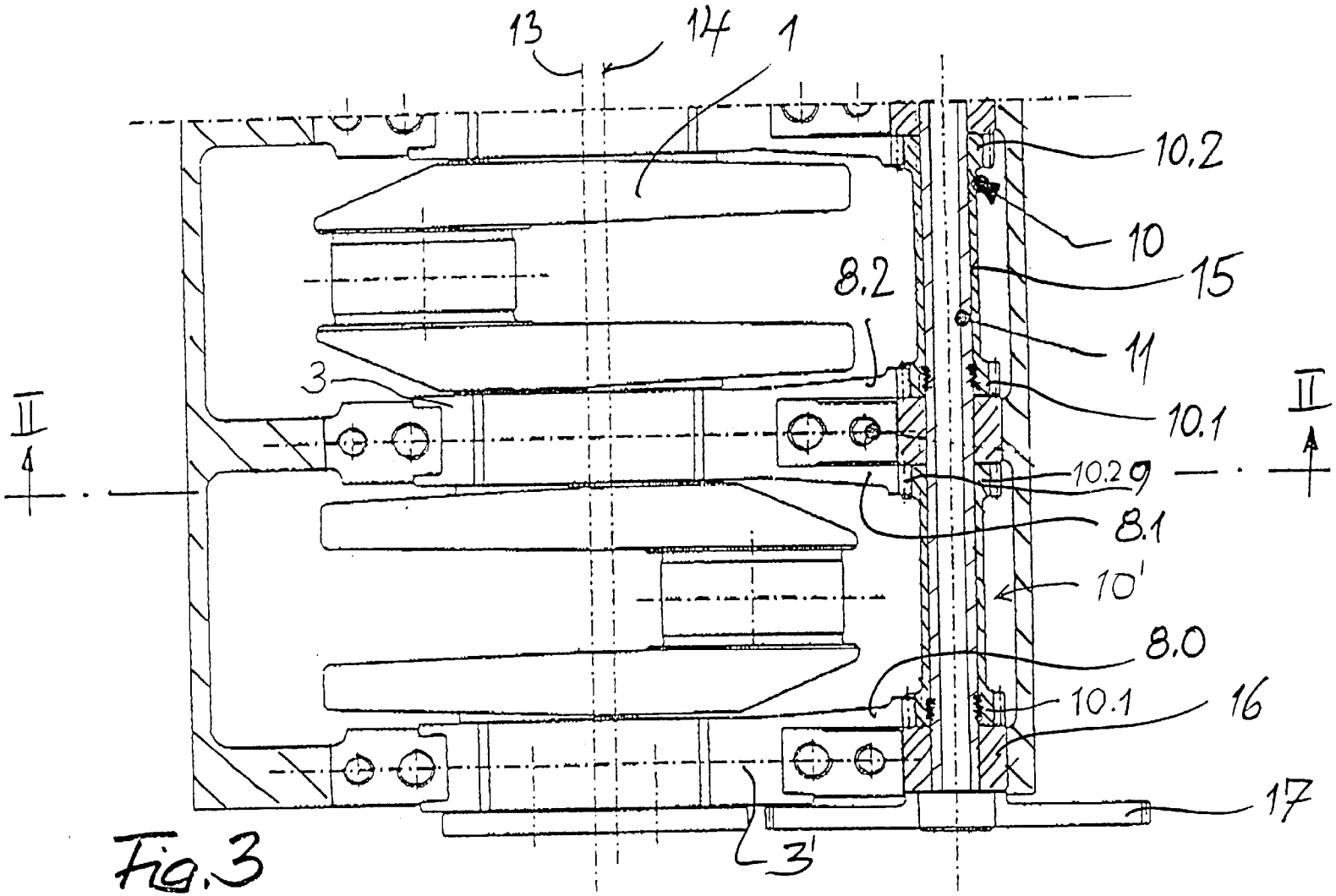
FIG. 3 is a sectional view taken along line III—III of FIG. 2.
Figure 4:
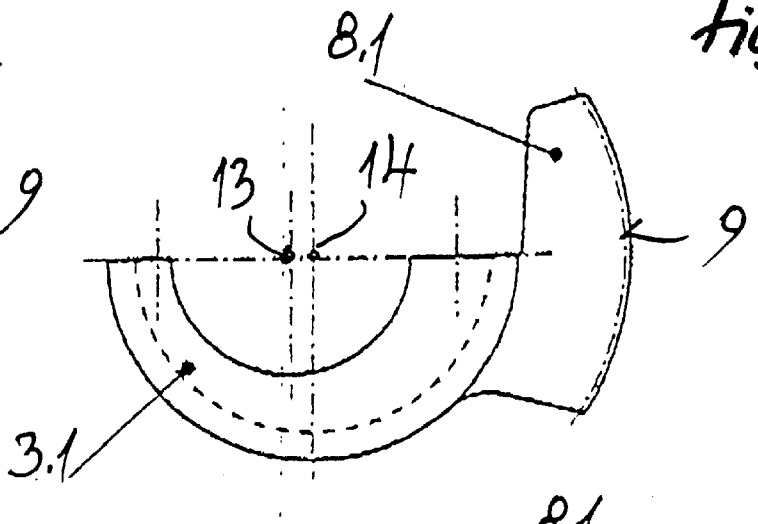
FIG. 4 is an end view of one part of a two-part eccentric ring.
Figure 5:
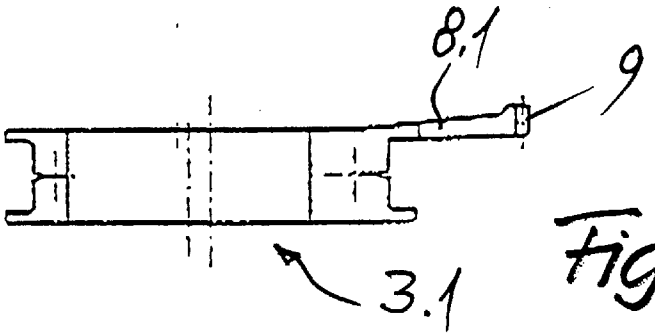
FIG. 5 is a top plan view of the construction shown in FIG. 4.
Figure 6:
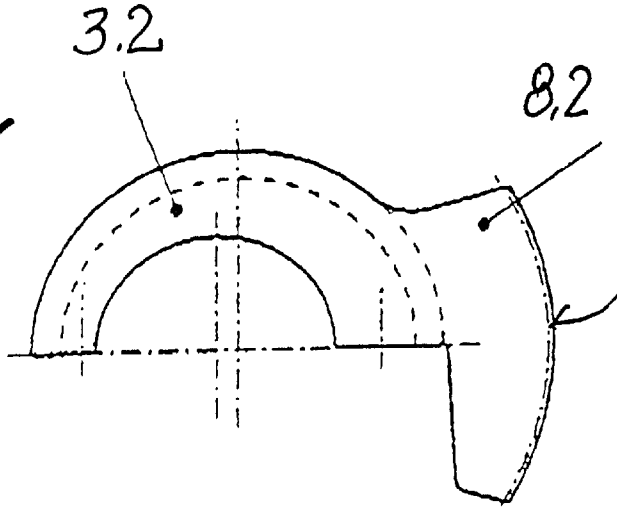
FIG. 6 is an end view of the other part of the two-part eccentric ring.
Figure 7:
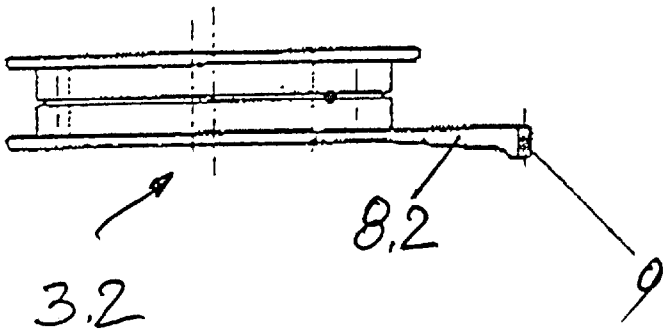
FIG. 7 is a top plan view of the construction shown in FIG. 6.

Turning to FIGS. 1, 2 and 3, a crankshaft 1 is, with its crankshaft bearings 2, supported in eccentric rings 3 which, in turn, are rotatably held in respective carrier bearings 4 of an engine block. Pistons 6.1, 6.2, 6.3 and 6.4 reciprocate in a respective cylinder 7 (shown only for the piston 6.1) and are connected by means of their respective connecting rods 5 with the crankshaft 1. The crankshaft 1 is shown in a position in which the pistons 6.1 and 6.4 are situated in their upper dead center whereas the pistons 6.2 and 6.3 are positioned in their lower dead center.

Each eccentric ring 3 is rigidly connected with a setting arm 8 which, at its free end, is provided with a toothed element 9. The toothed elements 9 mesh with respective pinion elements 10 which, in turn, are connected with a setting shaft 11 supported in the engine block and oriented parallel to the crankshaft 1. The setting shaft 11 is coupled with a setting drive 12 only symbolically illustrated in FIG. 1.

By turning the setting shaft 11 about a setting angle a in one direction of the two-directional arrow, the eccentric rings 3 are rotated about their stationary rotary axis 14 in the engine block and thus the crankshaft 1, eccentrically supported in the eccentric rings 3 is, with its crankshaft bearing 2, raised or lowered, that is, the rotary axis 13 of the crankshaft 1 is shifted. As a result, according to a motion of the eccentric rings upwardly or downwardly, the crown of the pistons 6.1 through 6.4 will be closer or farther from the roof of the combustion chamber of the respective cylinder 7 in the upper dead center position of the respective piston, whereby the compression ratio is deliberately altered. The entire arrangement is immobilized in the setting predetermined by the operating conditions by an arresting brake (not illustrated in FIG. 1) connected with the setting drive.

With reference to FIGS. 4, 5, 6 and 7, each eccentric ring 3 is formed of ring parts 3.1 and 3.2 provided with respective parallel setting arms 8.1 and 8.2, each carrying a toothed element 9. The toothed elements 9 of each eccentric ring 3 are at an axial clearance from one another. As shown at the bottom of FIG. 3, only the terminal eccentric ring 3' has a single setting arm 8.0 and is thus provided only with one toothed element.

In the embodiment illustrated in FIG. 3 the pinion element 10 is composed of two pinions 10.1 and 10.2 which are firmly connected with one another by a tubular torsion spring bar 15 through which the hollow setting shaft 11 axially passes. The pinion 10.1 of each pinion element 10 is rigidly affixed to the setting shaft 11, by the intermediary of the respective end of the torsion spring bar 15, for example, to a radial enlargement of the setting shaft 11. The portion of the torsion spring 15 extending from the pinion 10.1 to the pinion 10.2 is supported on the setting shaft 11 for free rotatable displacement relative to the pinion 10.1.

The setting shaft 11 is connected with bearing members 16 whose outer diameter is greater than the outer diameter of the pinion elements 10 so that the setting shaft 11, together with the inserted pinion elements 10, may be pushed through corresponding bore holes in the engine block. The ring parts 3.1 and 3.2 of each eccentric ring 3 are secured together by a screw connection to surround the respective principal crankshaft bearing, so that the two setting arms 8.1 and 8.2 of the eccentric ring 3 straddle the bearing and extend toward the setting shaft 11. The toothed elements 9 carried by the setting arms 8.1 and 8.2 mesh with a respective pinion 10.2 and 10.1.

As seen in FIG. 3, the setting arm 8.0 of the outermost eccentric ring 3' meshes with the pinion 10.1 which forms part of the pinion element 10' and which is fixedly connected with the setting shaft 11. The pinion 10.2 which forms part of the pinion element 10' and which is connected to the pinion 10.1 of the pinion element 10' by the tubular torsion spring bar 15, meshes with the toothed element 9 of the setting arm 8.1 of the adjoining eccentric ring 3. In this manner, progressing toward the other end of the setting shaft 11, the individual successive eccentric rings are interconnected by pinion elements. By providing that the teeth of the pinion 10.1 are, with respect to the teeth of the pinion 10.2 of the same a pinion element 10 slightly offset in the circumferential direction, during assembly the toothed elements connected to one another via the pinion element may be biased to one another by a resilient torque to thus eliminate any play between the teeth. This makes it feasible to make the part rings of the eccentric rings, for example, as sintered components, and the teeth of the toothed elements 9 need not be subjected to any finishing work. Similarly, it is feasible to make at least the pinion 10.1 or 10.2 of the pinion element 10 as a sintered component which may be fixedly mounted, for example, by shrink fitting, on a tubular torsion spring bar of suitable material and dimensions to ensure its required resiliency.

Figure 8:
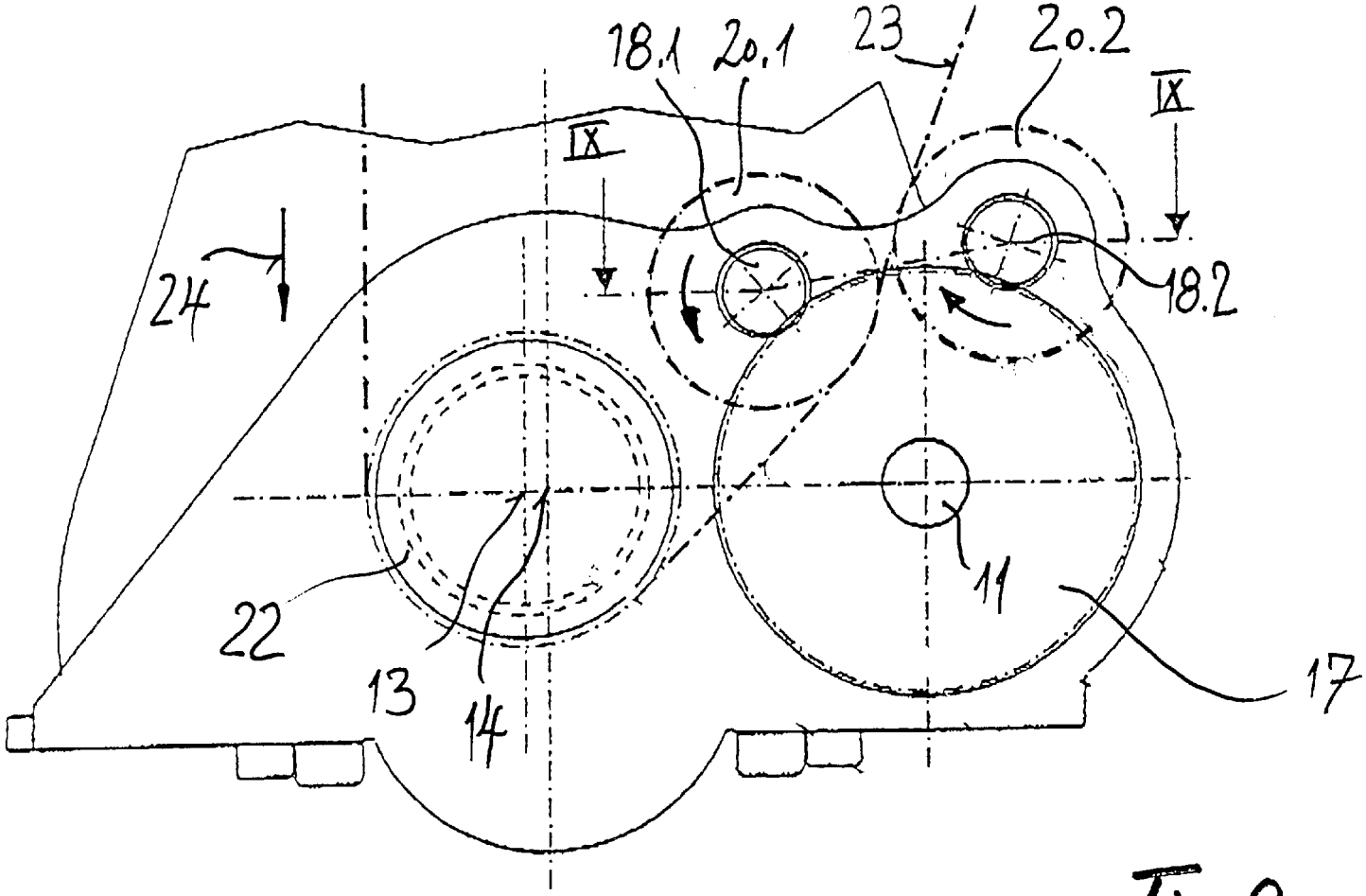
FIG. 8 is a schematic end elevational view of a piston-type internal-combustion engine illustrating the driving side of the setting drive according to the invention.
Figure 9:
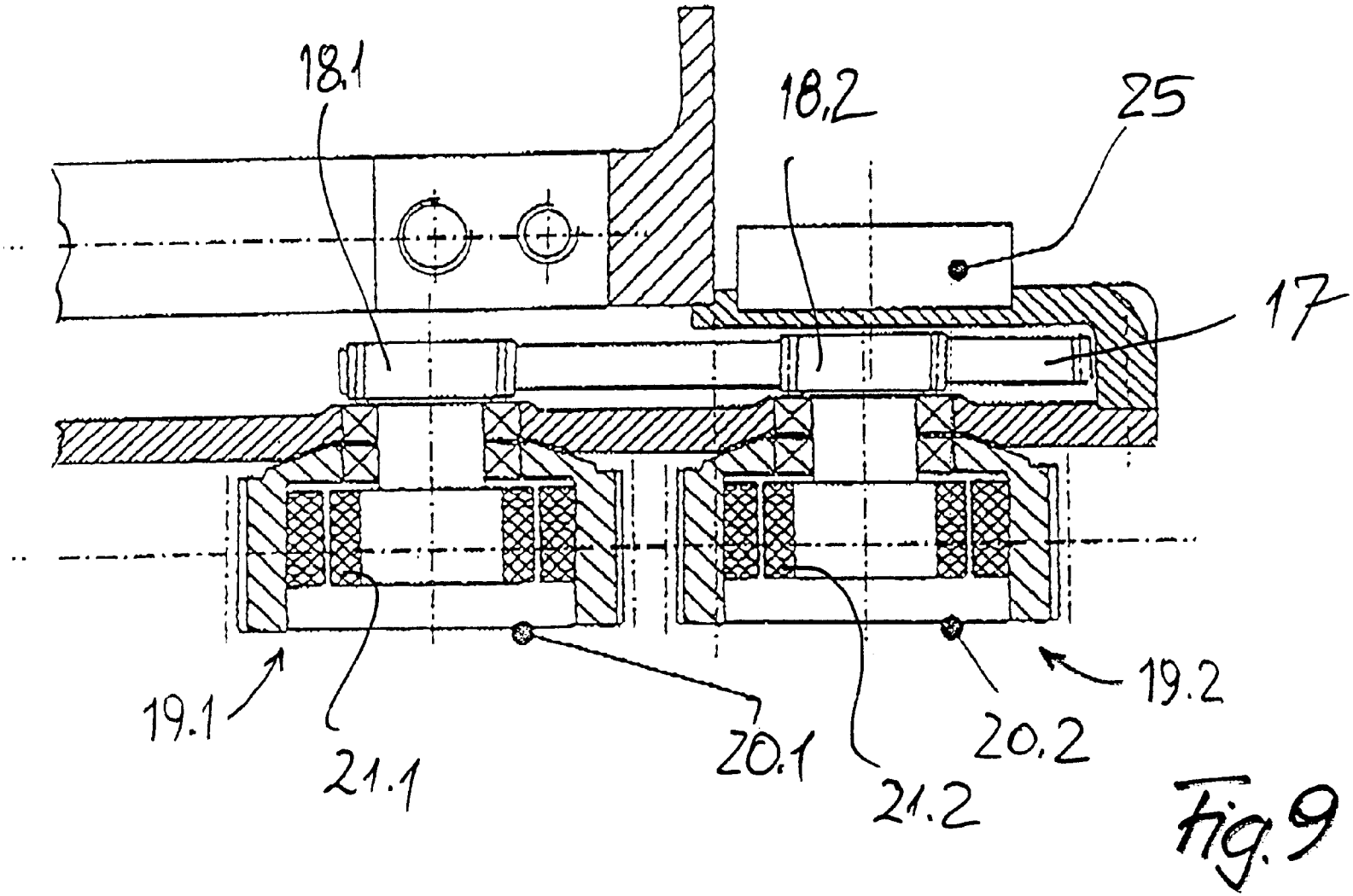
FIG. 9 is a sectional view taken along line IX—IX of FIG. 8.

FIGS. 8 and 9 illustrate a preferred embodiment of the setting drive 12. The setting drive 12 is composed essentially by a driven wheel 17, for example, a gear which is fixedly connected with the setting shaft 11. The driven wheel 17 is in a continuous meshing engagement with two driving wheels 18.1 and 18.2 whose diameter is smaller than that of the driven wheel 17.

As shown in FIG. 9, the driving wheels 18.1 and 18.2 are associated with respective magnetic slip clutches 19.1 and 19.2. The rotary input components 20.1 and 20.2 of the slip clutches are, in a released state of the clutches, freely rotatable relative to the respective rotary output components 21.1 and 21.2 which, in turn, are fixedly connected with the respective driving wheels 18.1 and 18.2.

The input components 20.1 and 20.2 of the two slip clutches 19.1 and 19.2 are rotated by a belt 23 trained about a belt pulley 22 connected to the crankshaft 1. The belt 23 is in a torque-transmitting contact with the input components 20.1 and 20.2 in such a manner that the latter rotate in opposite directions. Thus, while the circulating direction 24 of the belt 23 remains the same, the driving wheels 18.1 and 18.2 will rotate in opposite directions when the respective clutch 19.1 or 19.2 is engaged. The change of the height position of the belt pulley 23 with respect to the rotary axis 14 of the eccentric rings 3 caused by the shifting of the rotary axis 13 of the crankshaft 1 is compensated for by a non-illustrated belt tension compensating device.

As shown in FIG. 9, an arresting brake 25 holds the setting shaft 11 firmly in its set position via the driven wheel 17 for maintaining constant any set compression ratio. For changing the compression ratio, in the shifting direction given by the engine control, one of the two clutches 19.1 or 19.2 is engaged and the arresting brake 25 is released and thus the required angular displacement of the eccentric rings 3 is performed as determined by the engine control. As soon as the set position is reached, the arresting brake 25 is applied and the clutch is released so that the input component 20.1 or 20.2 again may rotate freely as determined by the circulating direction 24 of the belt 23 without a force transmission on the driven wheel 17 by the driving wheels 18.1 or 18.2.

It will be understood that the above description of the present invention is susceptible to various modifications, changes and adaptations, and the same are intended to be comprehended within the meaning and range of equivalents of the appended claims.

The free rotatable, i.e. circumferential displacement of pinion 10.2 versus the pinion 10.1 will be within the scale of the wear of the teeth of the pinions in order to overcome a play between the pinions and their toothed elements 9 respectively.

It will be understood that the above description of the present invention is susceptible to various modifications, changes and adaptations, and the same are intended to be comprehended within the meaning and range of equivalents of the appended claims.

What is claimed is:

1. An internal combustion engine comprising (a) an engine block;

(b) a plurality of cylinders arranged in line in said engine block;

(c) a piston accommodated for reciprocating motion in respective said cylinders; each said piston having an upper dead center position;

(d) a plurality of eccentric rings;

(e) ring bearings for supporting said eccentric rings in said engine block for rotation about a ring axis;

(f) a crankshaft;

(g) a plurality of crankshaft bearings supported in respective said eccentric rings and carrying said crankshaft for rotation about crankshaft axis being radially spaced from said ring axis;

(h) a respective connecting rod coupling each piston to said crankshaft;

(i) a respective setting arm secured to and projecting from each said eccentric ring;

(j) a respective toothed element carried by each said setting arm;

(k) a setting shaft rotatably supported on said engine block and being oriented parallel to said crankshaft;

(l) a plurality of pinion elements each having (1) first pinion fixedly secured to said setting shaft and meshing with the toothed element of one of the setting arms;

(2) second pinion rotatable relative to said first pinion and meshing with the toothed element of one of the setting arms; and (3) resilient connecting means for coupling said first and second pinions to one another and for resiliently resisting a rotation of said first and second pinions relative to one another whereby a resilient torque biases said first and second pinions toward one another; and (m) a setting drive for turning said setting shaft for adjusting together an angular position of said eccentric rings to radially shift said the crankshaft axis, whereby the upper dead center position of the pistons is altered for varying a compression ratio of the engine.

2. The internal-combustion engine as defined in claim 1, wherein the toothed elements of adjoining said setting arms are connected to one another by one of said pinion elements.

3. The internal-combustion engine as defined in claim 1, wherein said resilient connecting means comprises a tubular torsion spring bar.

4. The internal-combustion engine as defined in claim 3, wherein said setting shaft passes axially through said tubular torsion spring bar.

5. The internal-combustion engine as defined in claim 1, wherein said setting shaft is hollow and further wherein the first pinions of said pinion elements are affixed to a respective local enlargement of the hollow setting shaft.

6. The internal-combustion engine as defined in claim 1, wherein said setting shaft is surrounded by setting shaft bearings; and further wherein said setting shaft bearings have an outer diameter greater than a maximum outer diameter of said pinion elements.

7. The internal-combustion engine as defined in claim 1, wherein at least one of said eccentric rings is composed of two part rings defining a parting plane passing therebetweeen; wherein said parting plane intersects said crankshaft axis; and further wherein at least one of said part rings carries one of said setting arms.

8. The internal-combustion engine as defined in claim 7, wherein each said part ring forming one of said eccentric rings carries a respective said setting arm; and further wherein the setting arms carried by the ring parts one of said eccentric rings straddle said ring bearing.

9. The internal-combustion engine as defined in claim 8, wherein each said ring part, said setting arm carried thereby and the toothed element carried by the setting arm together form a single-piece, single-material component.

10. The internal-combustion engine as defined in claim 9, wherein said component is a sintered member.

11. The internal-combustion engine as defined in claim 1, wherein said setting drive comprises (a) a driven wheel having a first diameter; said driven wheel being affixed to said setting shaft;

(b) two driving wheels each having a second diameter being smaller than said first diameter; said driving wheels being continuously coupled to said driven wheel;

(c) first and second clutches each having a rotary output component secured to a respective said driving wheel and a rotary input component; said first and second clutches each having an engaged state for torque-transmittingly connecting the rotary input component with the rotary output component and a disengaged state for disconnecting the rotary input component from the rotary output component; and (d) a unidirectionally traveling driving member in continuous torque-transmitting contact with said rotary input components of said first and second clutches for continuously rotating said input components in opposite directions relative to one another, whereby upon selectively placing a selective said first or second clutch in the engaged state, said setting shaft is rotated in a selected direction into a selected angular position.

12. The internal-combustion engine as defined in claim 11, further comprising a locking brake for immobilizing said setting shaft upon reaching said selected angular position.

13. The internal-combustion engine as defined in claim 1, wherein said first and second clutches are magnetic slip clutches.

* * * * *